US012397971B2

(12) United States Patent
Hu

(10) Patent No.: US 12,397,971 B2
(45) Date of Patent: Aug. 26, 2025

(54) MAGNETIC SUCTION CUP WITH SPHERICAL CUP LID

(71) Applicant: ZHEJIANG FLY CUP CO., LTD, Jinhua (CN)

(72) Inventor: Feipeng Hu, Yongkang (CN)

(73) Assignee: ZHEJIANG FLY CUP CO.,LTD, Jinhua (CN)

( * ) Notice: Subject to any disclaimer, the term of this patent is extended or adjusted under 35 U.S.C. 154(b) by 0 days.

(21) Appl. No.: 18/627,699

(22) Filed: Apr. 5, 2024

(65) Prior Publication Data

US 2024/0246732 A1 Jul. 25, 2024

(30) Foreign Application Priority Data

Apr. 29, 2023 (CN) ..... 202310482129.X

(51) Int. Cl.
*B65D 43/02* (2006.01)
*A47G 19/22* (2006.01)
*B65D 47/06* (2006.01)

(52) U.S. Cl.
CPC ..... *B65D 47/06* (2013.01); *A47G 19/2205* (2013.01); *B65D 43/02* (2013.01); *B65D 2543/00277* (2013.01); *B65D 2547/063* (2013.01)

(58) Field of Classification Search
CPC .... B65D 43/02; B65D 43/0202; B65D 43/22; B65D 2543/00046; B65D 2543/00277; B65D 2547/063; B65D 55/16; B65D 2313/04; B65D 65/38; B65D 47/06; A47G 19/2272; A47G 19/2205; A47G 19/2261; A47G 2200/10; Y10S 206/818; Y10S 428/90; Y10S 7/901
USPC ..... 206/818; 220/223, 230, 483, 703
See application file for complete search history.

(56) References Cited

U.S. PATENT DOCUMENTS

| | | | | |
|---|---|---|---|---|
| 3,556,341 | A * | 1/1971 | Rains | A47G 23/0225 D7/510 |
| 2007/0012697 | A1* | 1/2007 | Holcomb | A47G 19/2272 220/254.9 |
| 2011/0062160 | A1* | 3/2011 | Vasic | A47G 19/2205 206/509 |
| 2019/0117000 | A1* | 4/2019 | Lockhart | A47G 19/2272 |
| 2019/0125111 | A1 | 5/2019 | Morewitz et al. | |

* cited by examiner

*Primary Examiner* — King M Chu
(74) *Attorney, Agent, or Firm* — Hemisphere Law, PLLC; Zhigang Ma

(57) ABSTRACT

The present disclosure belongs to the technical field of cups, and in particular, to a magnetic suction cup with a spherical cup lid. The magnetic suction cup includes a cup body and the spherical cup lid; the spherical cup lid is provided with a metal material capable of being attracted by a magnetic force; an upper end of the cup body is provided with an arc-shaped rim; a lower end of the rim is provided with a stop plate; a peripheral edge of the stop plate is connected to the cup body, and the stop plate is provided with several water passing holes.

7 Claims, 10 Drawing Sheets

MAGNETIC SUCTION CUP WITH SPHERICAL CUP LID

TECHNICAL FIELD

The present disclosure belongs to the technical field of cups, and in particular, to a magnetic suction cup with a spherical cup lid.

BACKGROUND

Scientific research has found that drinking water can promote the metabolism of people. The normal metabolism of a person requires 1.5 to 2 liters of water per day. A cup lid is used for dust prevention and thermal insulation for cups. As a tool used in daily life to hold liquids, a water cup has been widely used. It can be seen everywhere, in offices, schools, and people's hands. At present, with a traditional cup lid on the market, the cup is generally opened or closed by screwing on/off the cup lid through threads, buckling the cup lid, directly closing the cup lid, and the like. It is very cumbersome and inconvenient to use the cup lid that is opened through the threads. It is difficult for a user to open the cup lid with a single hand, and it will take a lot of effort. It is also very cumbersome to open and close the cup lid that is opened through a buckle, and the service life of this cup lid is short. The cup lid that is directly closed easily falls off due to vibrations, shake, and other reasons. Furthermore, in all of the opening ways, the cup lid needs to be aligned with a rim, otherwise, water easily leaks because of misalignment.

SUMMARY

The present disclosure aims to provide a magnetic suction cup with a spherical cup lid, which has a simple structure, is convenient to open without alignment, and is unlikely to leak water.

The objectives of the present disclosure are achieved below:

A magnetic suction cup with a spherical cup lid includes a cup body and the spherical cup lid, wherein the spherical cup lid is provided with a metal material capable of being attracted by a magnetic force; an upper end of the cup body is provided with an arc-shaped rim; a lower end of the rim is provided with a stop plate; a peripheral edge of the stop plate is connected to the cup body, and the stop plate is provided with several water passing holes; a water stop part is arranged between the rim and the stop plate; the water stop part can move up and down between the rim and the stop plate; the water stop part is larger than the lower end of the rim and the stop plate; when the water stop part moves up, the water stop part resists against the lower end of the rim, and the rim is closed; when the water stop part moves down, the water stop part resists against the stop plate, and the rim is opened; a magnetic suction member is arranged on the water stop part; when the spherical cup lid is arranged at the rim, the magnetic suction member is sucked to the spherical cup lid through a magnetic force, thus driving the water stop part to move up to close the rim; and when the spherical cup lid is opened, the magnetic suction member loses a suction force and drives the water stop part to be reset to open the rim.

Further, a through hole is arranged in a center of the stop plate; a lower end of the water stop part is provided with a connecting rod; the connecting rod is arranged in the through hole in a penetrating manner; a lower end of the connecting rod is provided with a silica gel sleeve; the water stop part is located above the stop plate; the silica gel sleeve is located below the stop plate; and the water stop part and the silica gel sleeve are both larger than the through hole.

Further, an upper end of the water stop part is provided with a silica gel layer; and when the water stop part moves up, the silica gel layer resists against the rim.

Further, the cup body is internally provided with a magnetic suction part for placing the spherical cup lid; and the spherical cup lid is sucked on a surface of the cup through the magnetic suction part.

Further, a surface of the cup body is sunken downwards to form a placement slot; the placement slot is arranged on an outer side of the magnetic suction part; and the placement slot is an arc shape matched with the spherical cup lid.

Compared with the prior art, the present disclosure has outstanding and beneficial technical effects:

The magnetic suction cup with the spherical cup lid has a simple structure, is convenient to open without alignment, and is unlikely to leak water. The magnetic suction cup includes a cup body and the spherical cup lid; the spherical cup lid is provided with a metal material capable of being attracted by a magnetic force; an upper end of the cup body is provided with an arc-shaped rim; a lower end of the rim is provided with a stop plate; a peripheral edge of the stop plate is connected to the cup body, and the stop plate is provided with several water passing holes; a water stop part is arranged between the rim and the stop plate; the water stop part can move up and down between the rim and the stop plate; the water stop part is larger than the lower end of the rim and the stop plate; when the water stop part moves up, the water stop part resists against the lower end of the rim, and the rim is closed; when the water stop part moves down, the water stop part resists against the stop plate, and the rim is opened; a magnetic suction member is arranged on the water stop part; when the spherical cup lid is arranged at the rim, the magnetic suction member is sucked to the spherical cup lid through a magnetic force, thus driving the water stop part to move up to close the rim; and when the spherical cup lid is opened, the magnetic suction member loses a suction force and drives the water stop part to be reset to open the rim. The magnetic suction member is a strong magnet, so that the magnetic suction member can drive the water stop part to move up and down to open or close the cup as long as the spherical cup lid is placed at or taken away from the rim, without alignment. This way is easier and more convenient. During use, the cup can be opened easily with a single hand. The spherical cup lid is sucked to the rim through the magnetic suction member and will not fall off even under great vibrations and shakes, so that missing of the spherical cup lid is avoided; and water in the cup will not leak when the cup is upside down.

Figure 1:
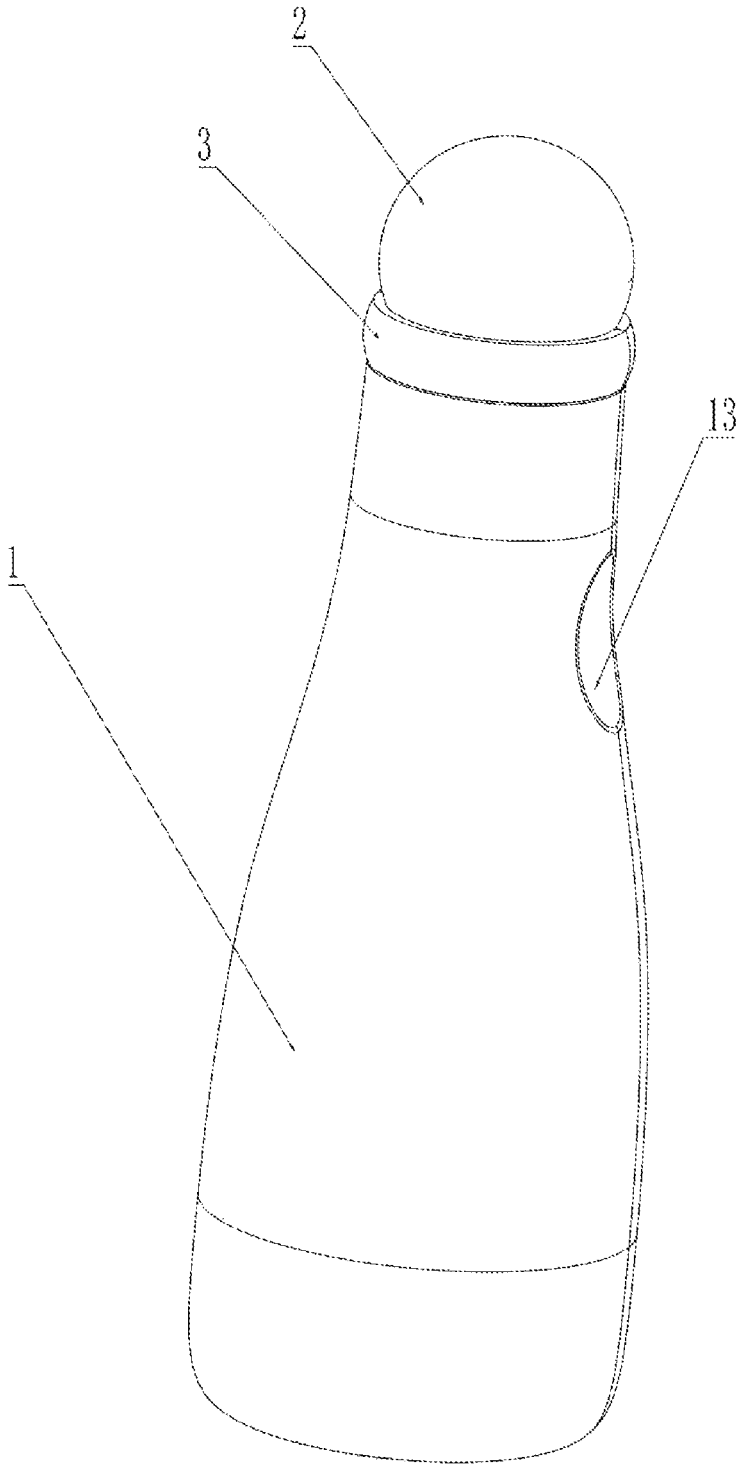
FIG. 1 is a three-dimensional diagram of the present disclosure.
Figure 2:
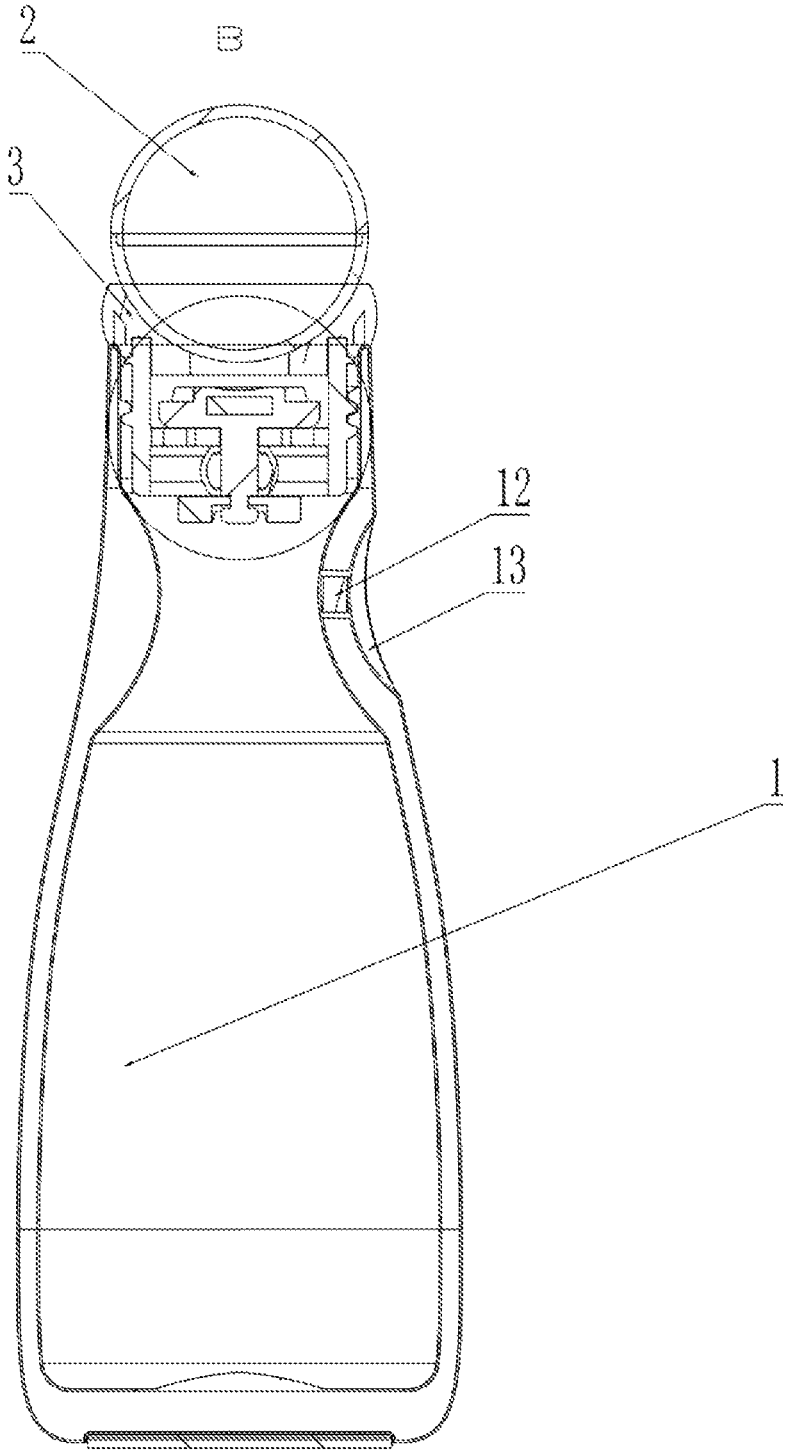
FIG. 2 is a cross-sectional view of the present disclosure.
Figure 3:
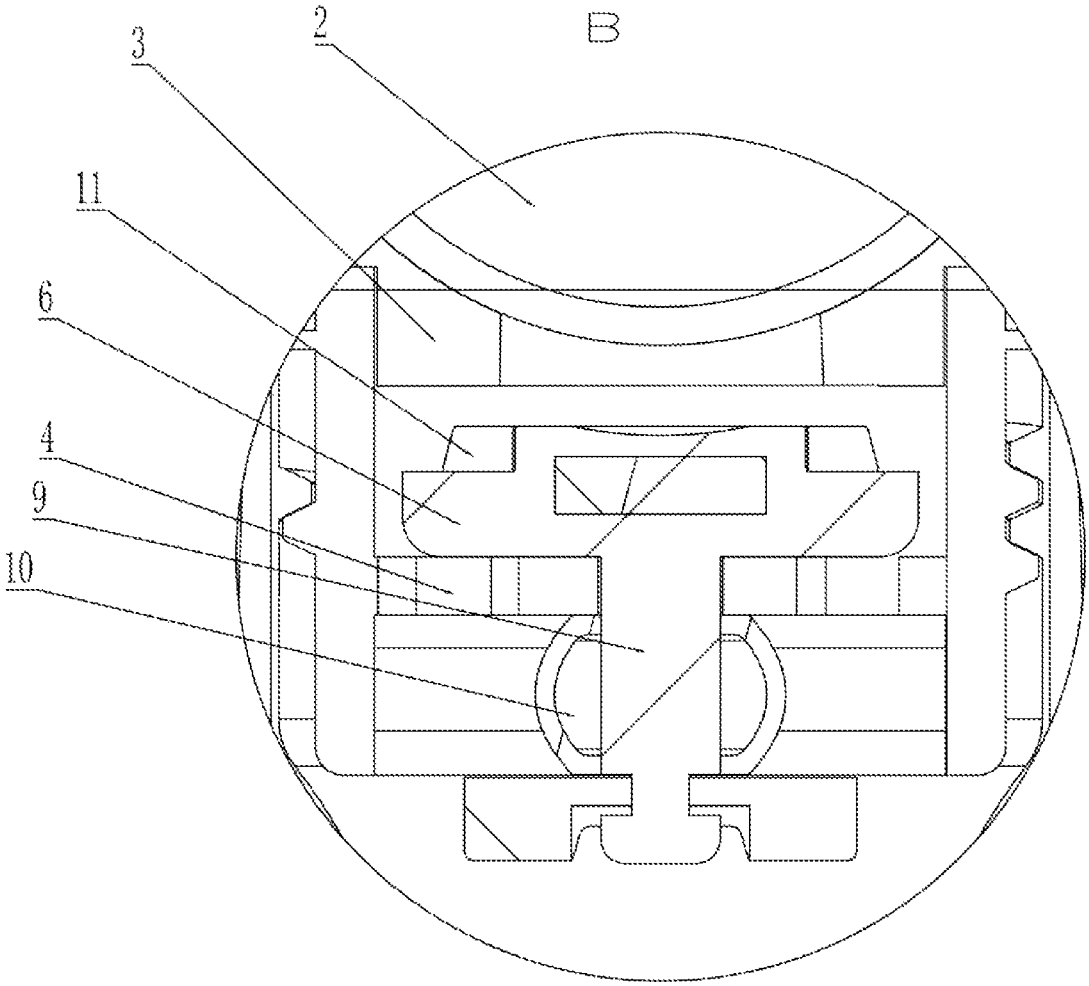
FIG. 3 is an enlarged diagram of part B in FIG. 2.
Figure 4:
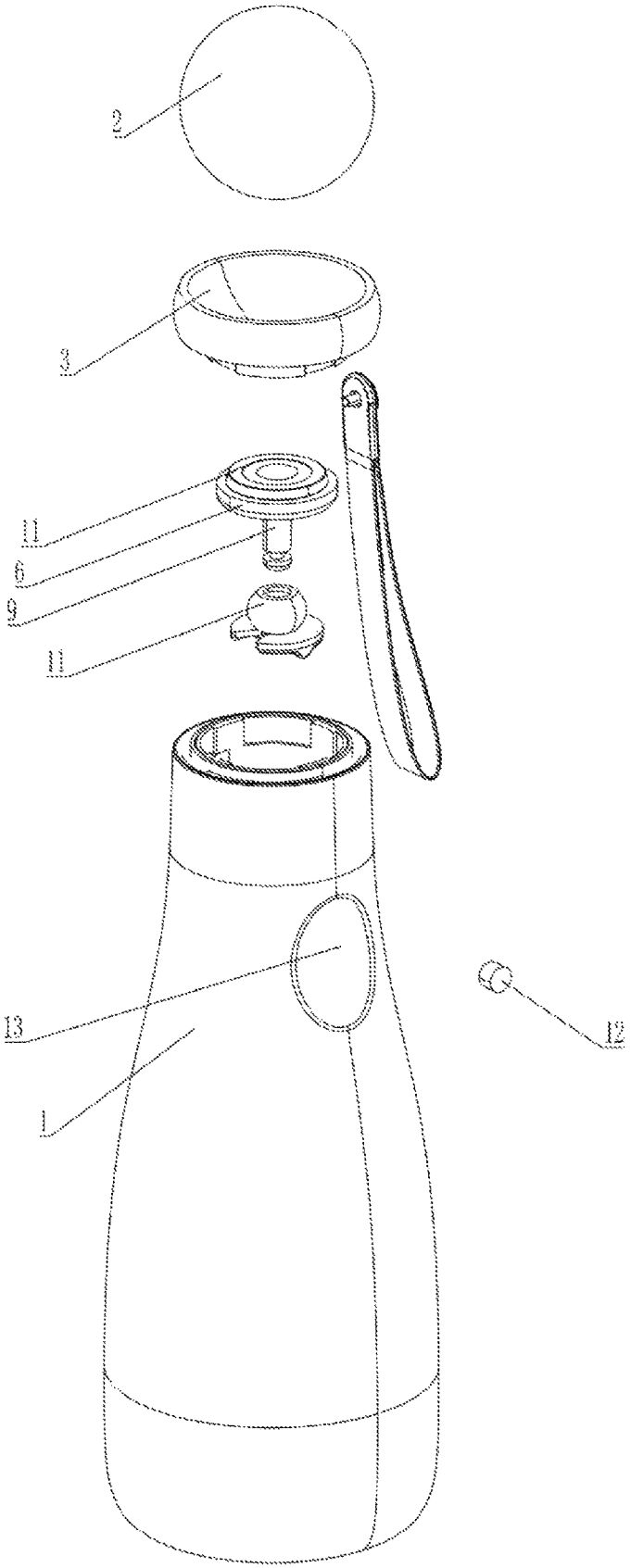
FIG. 4 is an exploded view of the present disclosure.
Figure 5:
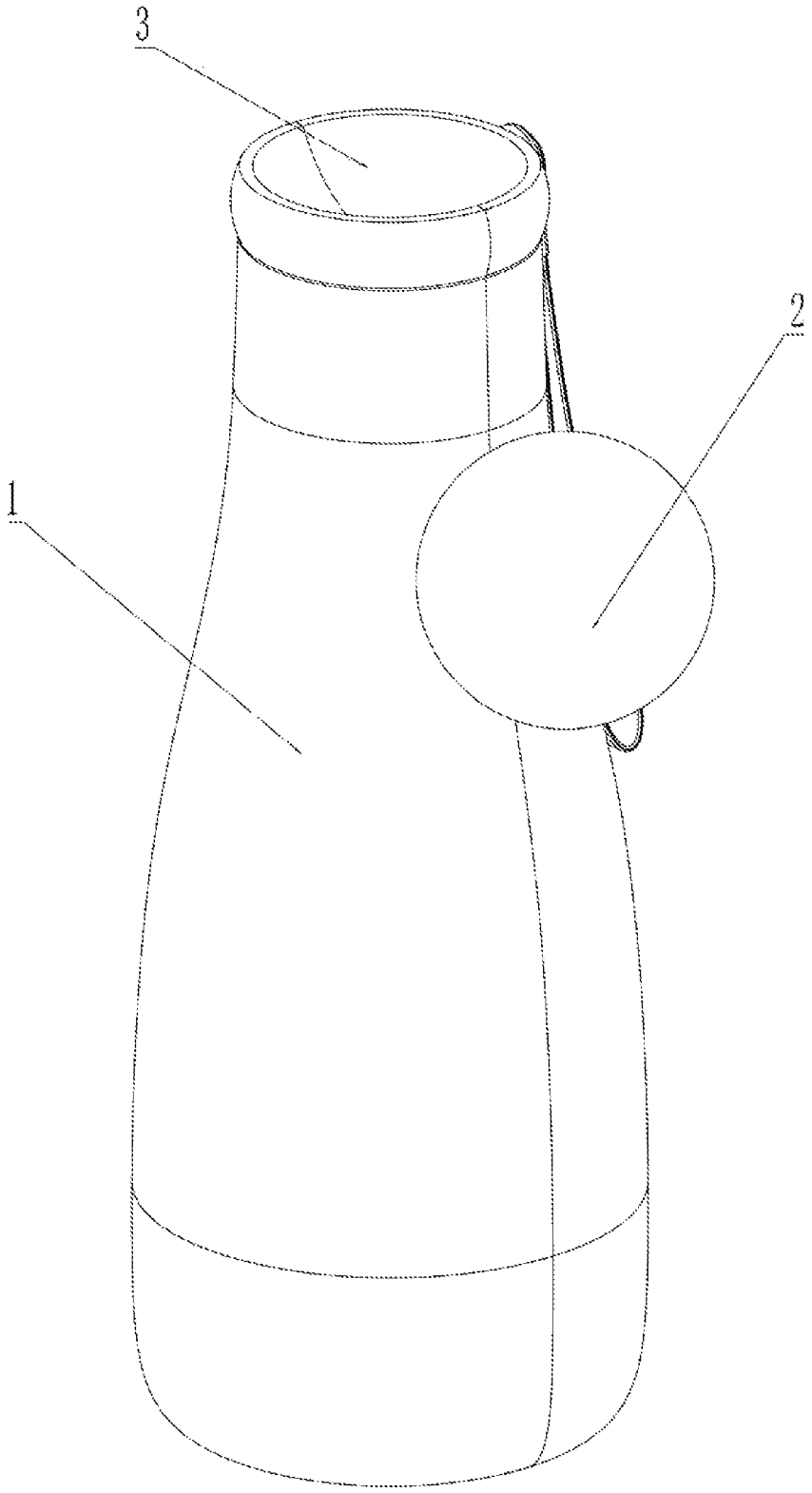
FIG. 5 is a schematic structural diagram of the present disclosure when a cup lid is opened.
Figure 6:
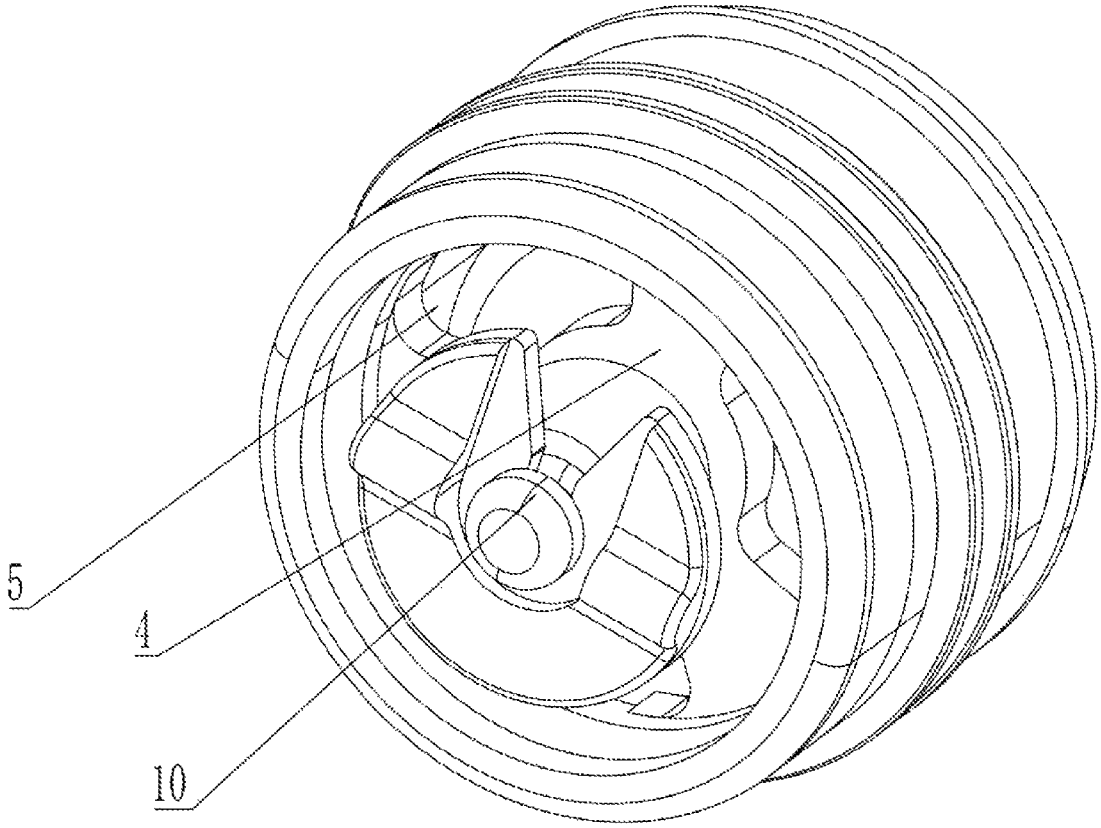
FIG. 6 is a schematic structural diagram of removing a cup lid and a cup body according to the present disclosure.
Figure 7:
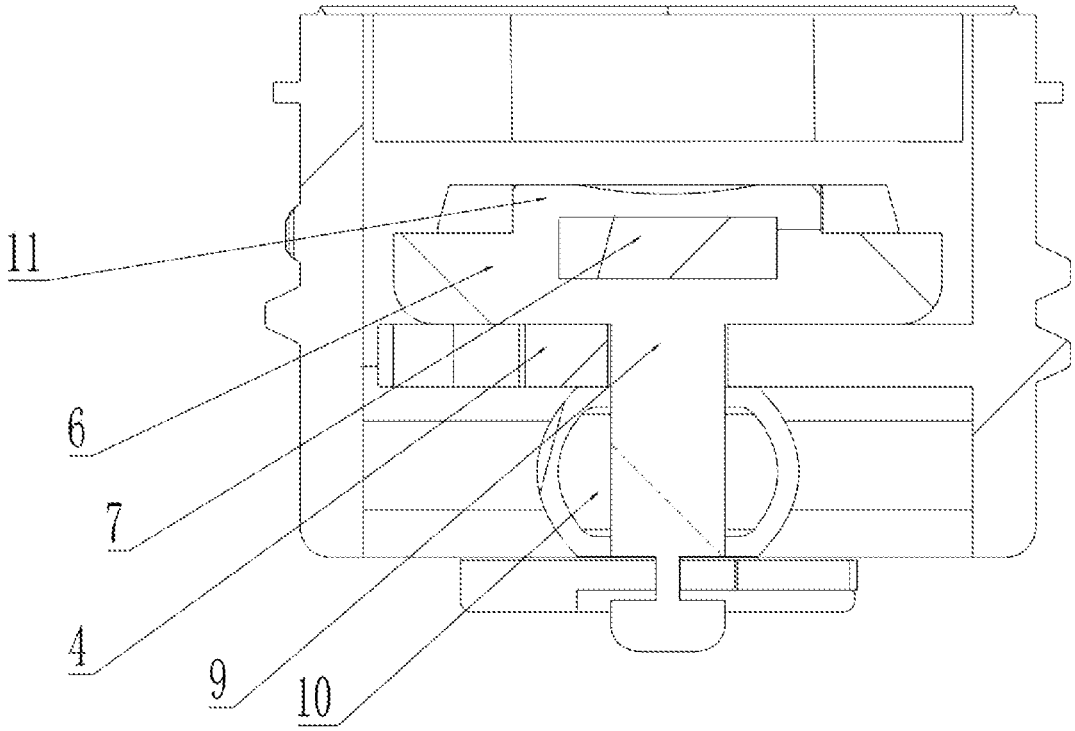
FIG. 7 is a cross-sectional view of removing a cup lid and a cup body according to the present disclosure.
Figure 8:
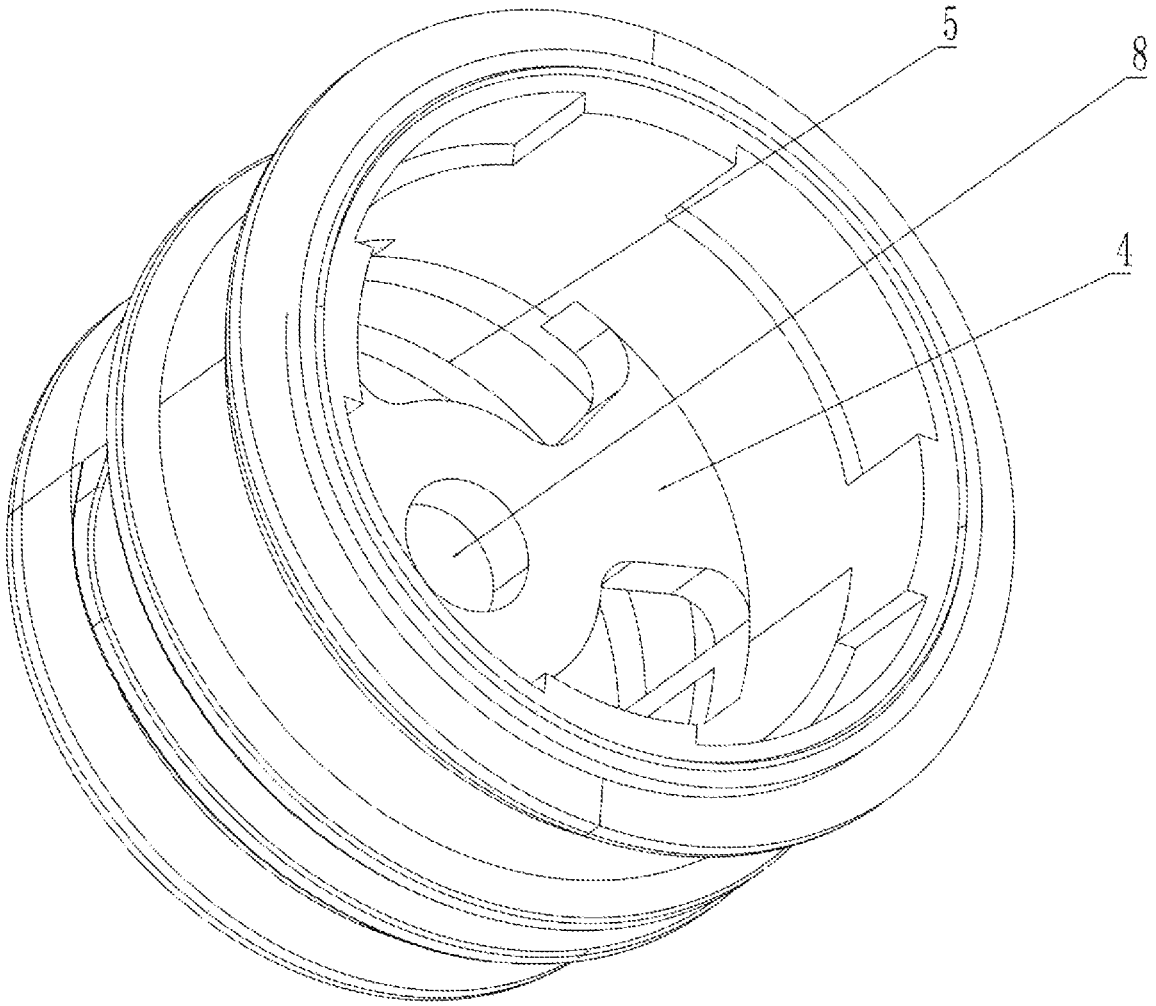
FIG. 8 is a schematic structural diagram of a stop plate according to the present disclosure.
Figure 9:
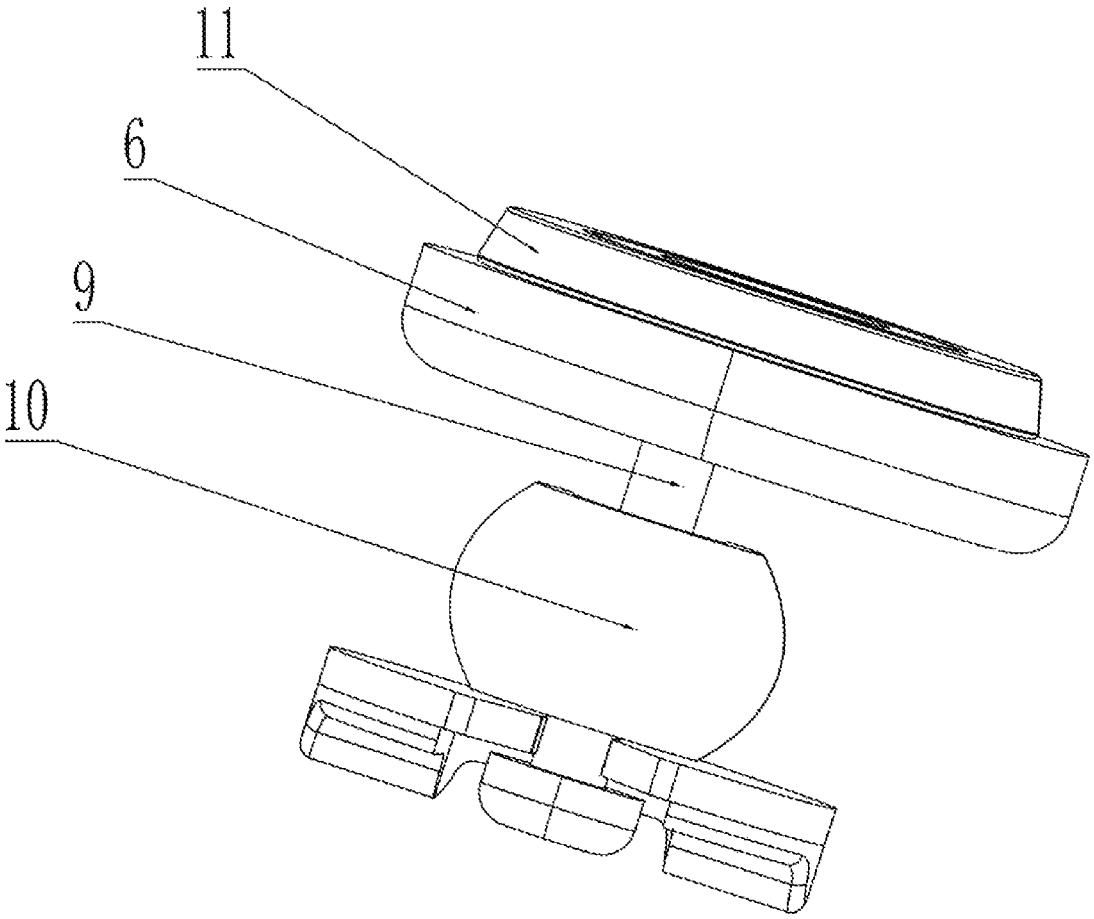
FIG. 9 is a schematic structural diagram of a water stop part according to the present disclosure.
Figure 10:
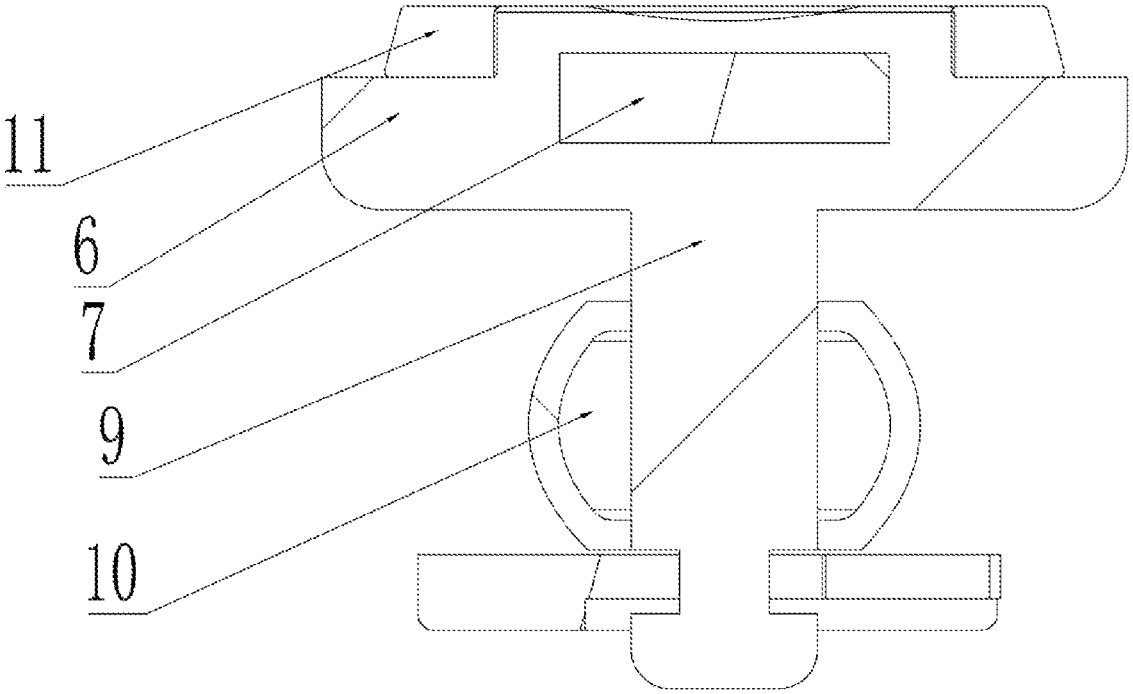
FIG. 10 is a cross-sectional view of a water stop part according to the present disclosure.

Meanings of reference numerals in the drawings:

1: cup body; 2: spherical cup lid; 3: rim; 4: stop plate; 5: water passing hole; 6: water stop part; 7: magnetic suction member; 8: through hole; 9: connecting rod; 10: silica gel sleeve; 11: silica gel layer; 12: magnetic suction art; and

13: placement slot.

DETAILED DESCRIPTION OF THE EMBODIMENTS

The present invention will be further described below in conjunction with the specific embodiments.

A magnetic suction cup with a spherical cup lid includes a cup body 1 and the spherical cup lid 2, wherein the spherical cup lid 2 is provided with a metal material capable of being attracted by a magnetic force; an upper end of the cup body 1 is provided with an arc-shaped rim 3; a lower end of the rim 3 is provided with a stop plate 4; a peripheral edge of the stop plate 4 is connected to the cup body 1, and the stop plate 4 is provided with several water passing holes 5; a water stop part 6 is arranged between the rim 3 and the stop plate 4; the water stop part 6 can move up and down between the rim 3 and the stop plate 4; the water stop part 6 is larger than the lower end of the rim 3 and the stop plate 4; when the water stop part 6 moves up, the water stop part 6 resists against the lower end of the rim 3, and the rim 3 is closed; when the water stop part 6 moves down, the water stop part 6 resists against the stop plate 4, and the rim 3 is opened; a magnetic suction member 7 is arranged on the water stop part 6; when the spherical cup lid 2 is arranged at the rim 3, the magnetic suction member 7 is sucked to the spherical cup lid 2 through a magnetic force, thus driving the water stop part 6 to move up to close the rim 3; and when the spherical cup lid 2 is opened, the magnetic suction member 7 loses a suction force and drives the water stop part 6 to be reset to open the rim 3.

The magnetic suction cup with the spherical cup lid has a simple structure, is convenient to open without alignment, and is unlikely to leak water. The magnetic suction cup includes a cup body 1 and the spherical cup lid 2; the spherical cup lid 2 is provided with a metal material capable of being attracted by a magnetic force; an upper end of the cup body 1 is provided with an arc-shaped rim 3; a lower end of the rim 3 is provided with a stop plate 4; a peripheral edge of the stop plate 4 is connected to the cup body 1, and the stop plate 4 is provided with several water passing holes 5; a water stop part 6 is arranged between the rim 3 and the stop plate 4; the water stop part 6 can move up and down between the rim 3 and the stop plate 4; the water stop part 6 is larger than the lower end of the rim 3 and the stop plate 4; when the water stop part 6 moves up, the water stop part 6 resists against the lower end of the rim 3, and the rim 3 is closed; when the water stop part 6 moves down, the water stop part 6 resists against the stop plate 4, and the rim 3 is opened; a magnetic suction member 7 is arranged on the water stop part 6; when the spherical cup lid 2 is arranged at the rim 3, the magnetic suction member 7 is sucked to the spherical cup lid 2 through a magnetic force, thus driving the water stop part 6 to move up to close the rim 3; and when the spherical cup lid 2 is opened, the magnetic suction member 7 loses a suction force and drives the water stop part 6 to be reset to open the rim 3. When the spherical cup lid 2 is opened, the magnetic suction member 7 loses a suction force and drives the water stop part 6 to be reset to open the rim 3. The magnetic suction member 7 is a strong magnet, so that the magnetic suction member 7 can drive the water stop part 6 to move up and down to open or close the cup as long as the spherical cup lid 2 is placed at or taken away from the rim 3, without alignment. This way is easier and more convenient. During use, the cup can be opened easily with a single hand. The spherical cup lid 2 is sucked to the rim 3 through the magnetic suction member 7 and will not fall off even under great vibrations and shakes, so that missing of the spherical cup lid 2 is avoided; and water in the cup will not leak when the cup is upside down.

Preferably, a through hole 8 is arranged in a center of the stop plate 4; a lower end of the water stop part 6 is provided with a connecting rod 9; the connecting rod 9 is arranged in the through hole 8 in a penetrating manner; a lower end of the connecting rod 9 is provided with a silica gel sleeve 10; the water stop part 6 is located above the stop plate 4; the silica gel sleeve 10 is located below the stop plate 4; and the water stop part 6 and the silica gel sleeve 10 are both larger than the through hole 8. When the rim 3 is closed, the water stop part 6 resists against the lower end of the rim 3, so that the connecting rod 9 moves up, and the silica gel sleeve 10 is stopped by the stop plate 4 from moving up and thus retracts; and when the rim 3 is opened, the water stop part 6 resists against the stop plate 4, so that the connecting rod 9 moves down, and the silica gel sleeve 10 is reset. To drink water, the stop plate 4 restrains a position of the silica gel sleeve 10, so that the water stop part 6 will not move towards the rim 3 and will not close the rim 3, and it is convenient for a user to drink water.

Preferably, an upper end of the water stop part 6 is provided with a silica gel layer 11; and when the water stop part 6 moves up, the silica gel layer 11 resists against the rim 3. The water stop part is a soft material, which facilitates tightly closing the rim 3 to avoid leakage of water when the cup is upside down.

Preferably, the cup body 1 is provided with a magnetic suction part 12 for placing the spherical cup lid 2; and the spherical cup lid 2 can be sucked on a surface of the cup through the magnetic suction part 12. The spherical cup lid 2 easily rolls when placed on a tabletop, so it needs to be placed in another place, otherwise, it is easy to lose. Furthermore, the spherical cup lid 2 may be stained if it is placed randomly, and the rim 3 may also be stained when the spherical cup lid is covered back at the rim 3. The spherical cup lid 2 is not easy to lose and cleaner when it is sucked to the cup body 1 through the magnetic suction part 12.

Preferably, a surface of the cup body 1 is sunken downwards to form a placement slot 13; the placement slot 13 is arranged on an outer side of the magnetic suction part 12; and the placement slot 13 is an arc shape matched with the spherical cup lid 2, making it easy to place the spherical cup lid 2, so that the spherical cup lid will not slide downwards due to its gravity. The placement slot 13 plays a certain limiting role.

The above embodiments are only preferred embodiments of the present disclosure, and do not limit the protection scope of the present disclosure. Therefore, any equivalent changes made on the basis of the structure, shape, and principle of the present disclosure shall all fall within the protection scope of the present disclosure.

What is claimed is:

1. A magnetic suction cup with a spherical cup lid, wherein the magnetic suction cup comprises a cup body (1) and the spherical cup lid (2), wherein the spherical cup lid (2) is provided with a metal material capable of being attracted by a magnetic force; an upper end of the cup body (1) is provided with an arc-shaped rim (3); an inner end of the rim (3) is provided with a stop plate (4); a peripheral edge of the stop plate (4) is connected to the cup body (1), and the stop plate (4) is provided with several water passing holes (5); a water stop part (6) is arranged between the rim (3) and the stop plate (4); the water stop part (6) moves up and down between the rim (3) and the stop plate (4); when the water stop part (6) moves up, the water stop part (6) resists against a lower end of the rim (3), and the rim (3) is closed; when the water stop part (6) moves down, the water stop part (6) resists against the stop plate (4), and the rim (3) is opened; a magnetic suction member (7) is arranged on the water stop part (6); when the spherical cup lid (2) is arranged at the rim (3), the magnetic suction member (7) is sucked to the spherical cup lid (2) through a magnetic force, thus driving the water stop part (6) to move up to close the rim (3); and when the spherical cup lid (2) is opened, the magnetic suction member (7) loses a suction force and drives the water stop part (6) to be reset to open the rim (3).

2. The magnetic suction cup with the spherical cup lid according to claim 1, wherein a through hole (8) is arranged in a center of the stop plate (4); a lower end of the water stop part (6) is provided with a connecting rod (9); the connecting rod (9) is arranged in the through hole (8) in a penetrating manner; a lower end of the connecting rod (9) is provided with a silica gel sleeve (10); the water stop part (6) is located above the stop plate (4); the silica gel sleeve (10) is located below the stop plate (4); and the water stop part (6) and the silica gel sleeve (10) are both larger than the through hole (8).

3. The magnetic suction cup with the spherical cup lid according to claim 2, wherein an upper end of the water stop part (6) is provided with a silica gel layer (11); and when the water stop part (6) moves up, the silica gel layer (11) resists against the rim (3).

4. The magnetic suction cup with the spherical cup lid according to claim 1, wherein the cup body (1) is provided with a magnetic suction part (12) for placing the spherical cup lid (2); and the spherical cup lid (2) is sucked on a surface of the cup through the magnetic suction part (12).

5. The magnetic suction cup with the spherical cup lid according to claim 2, wherein the cup body (1) is provided with a magnetic suction part (12) for placing the spherical cup lid (2); and the spherical cup lid (2) is sucked on a surface of the cup through the magnetic suction part (12).

6. The magnetic suction cup with the spherical cup lid according to claim 3, wherein the cup body (1) is provided with a magnetic suction part (12) for placing the spherical cup lid (2); and the spherical cup lid (2) is sucked on a surface of the cup through the magnetic suction part (12).

7. The magnetic suction cup with the spherical cup lid according to claim 4, wherein a surface of the cup body (1) is sunken downwards to form a placement slot (13); the placement slot (13) is arranged on an outer side of the magnetic suction part (12); and the placement slot (13) is an arc shape matched with the spherical cup lid (2).

* * * * *